US008079417B2

(12) United States Patent
Wegener et al.

(10) Patent No.: US 8,079,417 B2
(45) Date of Patent: Dec. 20, 2011

(54) WIRELINE RETRIEVABLE DSG/DOWNHOLE PUMP SYSTEM FOR CYCLIC STEAM AND CONTINUOUS STEAM FLOODING OPERATIONS IN PETROLEUM RESERVOIRS

(75) Inventors: Dennis C. Wegener, Bartlesville, OK (US); Riley B. Needham, Bartlesville, OK (US); David R. Zornes, Bartlesville, OK (US); Partha S. Sarathi, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 211 days.

(21) Appl. No.: 12/190,709

(22) Filed: Aug. 13, 2008

(65) Prior Publication Data

US 2008/0302523 A1 Dec. 11, 2008

(51) Int. Cl.
*E21B 43/24* (2006.01)

(52) U.S. Cl. ..... 166/303; 166/105; 166/62

(58) Field of Classification Search ..... 166/302, 166/303, 272.3, 60, 62, 103, 105; 392/305, 392/303; 219/415
See application file for complete search history.

(56) References Cited

U.S. PATENT DOCUMENTS

| | | | | |
|---|---|---|---|---|
| 2,980,184 | A | 4/1961 | Reed | |
| 3,324,948 | A | 6/1967 | Powers et al. | |
| 3,369,604 | A * | 2/1968 | Black et al. | 166/261 |
| 3,712,375 | A | 1/1973 | Berry et al. | |
| 4,079,784 | A * | 3/1978 | Howard et al. | 166/256 |
| 4,865,130 | A * | 9/1989 | Ware et al. | 166/303 |
| 4,930,454 | A | 6/1990 | Latty et al. | |
| 4,988,389 | A * | 1/1991 | Adamache et al. | 166/302 |
| 5,447,201 | A | 9/1995 | Mohn | |
| 5,992,468 | A | 11/1999 | Dwiggins | |
| 6,206,093 | B1 * | 3/2001 | Lee et al. | 166/60 |
| 6,782,947 | B2 * | 8/2004 | de Rouffignac et al. | 166/245 |
| 2006/0175061 | A1 * | 8/2006 | Crichlow | 166/302 |
| 2006/0180316 | A1 | 8/2006 | Steele et al. | |
| 2008/0083536 | A1 * | 4/2008 | Cavender et al. | 166/302 |

FOREIGN PATENT DOCUMENTS

| | | | |
|---|---|---|---|
| EP | 069 827 | A2 | 1/1983 |
| EP | 69827 | A2 * | 1/1983 |
| EP | 0069827 | A2 | 1/1983 |

* cited by examiner

*Primary Examiner* — Kenneth L Thompson

(57) ABSTRACT

A non-rigid carrier conveys a pump and/or the steam generator through a bore of the production tubing string to support enhanced oil recovery operations. An annular space separates the production tubing string and a wall of a wellbore intersecting a hydrocarbon-bearing subterranean formation. Using the non-rigid carrier, the steam generator is conveyed into the wellbore and operated to inject hot gases into the formation through the perforations in the casing. Afterwards, the steam generator is conveyed out of the cased wellbore and the pump is conveyed into the cased wellbore and operated to pump hydrocarbons to the surface. For cyclic injection operations, the pump may be retrieved to the surface and the steam generator may be returned into the well. The production tubing string, such as a production tubing, remains in the well while the pump and/or the steam generator are conveyed up and down the cased well. A base installed in the cased well receives either the pump or the steam generator.

10 Claims, 2 Drawing Sheets

WIRELINE RETRIEVABLE DSG/DOWNHOLE PUMP SYSTEM FOR CYCLIC STEAM AND CONTINUOUS STEAM FLOODING OPERATIONS IN PETROLEUM RESERVOIRS

CROSS-REFERENCE TO RELATED APPLICATIONS

Background of the Disclosure

1. Field of the Disclosure

The disclosure relates generally to systems and methods for enhanced production of hydrocarbons using steam injection.

2. Description of the Related Art

Techniques generally referred to as enhanced oil recovery (EOR) are often utilized when the natural driving forces in an oil bearing reservoir are insufficient to produce sufficient oil to make recovery economically practical. Due to the success of EOR techniques in the recovery from reservoirs containing relatively light oils, operators have applied EOR techniques in oil fields that have heavier oils. One technique involves the introduction of thermal energy in the form of steam into a heavy oil bearing formation. The steam may be injected either through a single production well, in which injection of steam and production of oil are alternated (huff and puff), or through an injection well that is offset from a production well. The thermal energy increases the mobility of the heavy oil and allows the heavy oil to flow more easily into the production well.

Originally, the thermal stimulation called for a steam generator located at the surface with the steam being injected into the treated well. Thereafter, downhole steam generators were developed. The downhole steam generators are configured to be lowered into a cased well borehole, a partially cased well or cased well to generate steam near the downhole perforations. Conventionally, a well includes a production tubing string positioned in the borehole. The generator is lowered down the cased wellbore along with the production tubing string or before the installation of the production tubing string and positioned at the level of the formation to be treated. During operation, the generator generates and injects thermal energy in the form of steam or steam and exhaust gases into the formation which improves the heavy oil mobility. After a desired period of soak time, the production tubing string is removed. Thereafter, the steam generator is withdrawn from the borehole and replaced by a pump that upon operation pumps the oil that is mobilized by the steam to the surface.

The costs associated with the removal of the production tubing string can be significant. Thus, there is a need for more efficient systems and methods for deploying steam generators and pumps to support steam injection operations.

SUMMARY OF THE DISCLOSURE

In aspects, the present disclosure provides methods of recovering hydrocarbons from a subterranean formation. As will be appreciated, these methods do not require the removal of production/completion tubing that has been installed in a wellbore intersecting the formation. In one embodiment, the method includes installing a production tubing string in the wellbore and positioning a steam generator in the wellbore either before, during or after the production tubing string is installed. The production tubing string may be a production tubular positioned such that an annular space separates the production tubing string and the casing. After installation in the well, the steam generator is operated to inject steam and/or other hot gases into the formation. For cased or partially cased well, the steam generator is operated to inject steam and/or other hot gases into the formation through perforations in a cased portion of the well. The formation may be allowed to soak in the hot gases for a desired period, The desired period is based upon past experience with the well and/or those nearby. After the desired soak period has concluded, the well may be opened for production. If the well produces live steam after opening up for production, it may be shut in to allow for an additional soak period, if desired. The thermal energy associated with the hot gases may increase the mobility of the hydrocarbons in the formation. To retrieve these hydrocarbons, the method further includes conveying the steam generator to the surface via a bore of the production tubing string; and conveying a pump into the wellbore via the bore of the production tubing string. After installation, the pump is operated to flow the hydrocarbons to the surface via the bore of the production tubing string.

In embodiments for cyclic steam injection, the steam generator and pump are alternately installed and operated in a well in which the casing has been installed. Advantageously, such installations also do not require the removal of the installed production tubing strings. For example, after operation for a desired time, the pump may be retrieved to the surface via the bore of the production tubing string. Thereafter, the steam generator may be returned to the well via the bore of the production tubing string and operated for a specified period of time. Once the desired amount of thermal energy has been released into the well, the steam generator is again retrieved via the bore of the production tubing string and the pump is returned to the wellbore via the bore of the production tubing string and operated. The steps of conveying the steam generator and the pump into and out of the wellbore may be repeated as many times as desired. The pump and/or the steam generator may be conveyed along the wellbore using a non-rigid carrier such as a wireline or slickline.

In embodiments, the method may utilize a base installed in the wellbore. The base may be positioned along the production tubing string or in a section of the well below the production tubing string. The section below the production tubing string may be cased, partially cased or uncased. Also, the base may be configured to receive either the pump or the steam generator. The connection between the base and the pump/steam generator may utilize hydraulics, pneumatics, mechanical connections, and/or electromechanical arrangements. A method utilizing such a base may include positioning the steam generator on the base; retrieving the steam generator; and positioning the pump on the base after the retrieving the steam generator.

In aspects, the present disclosure also provides a system for recovering hydrocarbons from a wellbore intersecting a subterranean formation. The system may include a production tubing string, a steam generator, and a pump. The production tubing string is positioned in the wellbore such that an annular space separates the production tubing string and a wall of the wellbore. The steam generator and the pump are configured to be conveyed through a bore of the production tubing string. In one embodiment, the system may include a base associated with the production tubing string that is configured to receive either the steam generator or the pump. The system may further include a non-rigid carrier, such as a wireline or a slickline, to convey the pump and/or the steam generator through the bore of the production tubing string. In one embodiment, the system may include a distributed temperature sensor system (DTS) to measure formation temperature profiles to adjust the steam injection rate or total steam injected or both.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 2:
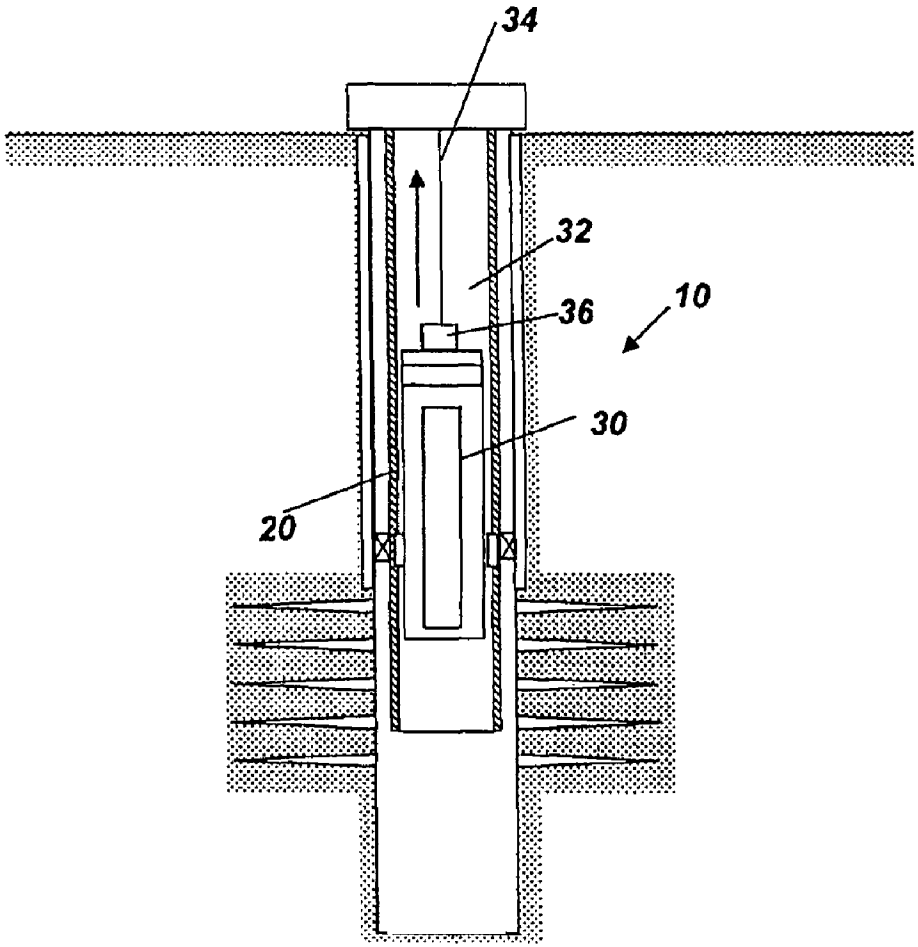
FIG. 2 is a schematic elevation view of a well wherein the downhole steam generator is being extracted from the well via a bore of a production tubing string in accordance with one embodiment of the present disclosure.

The present disclosure relates to devices and methods for deploying steam generators and pumps in connection with steam injection operations. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein. Further, while embodiments may be described as having one or more features or a combination of two or more features, such a feature or a combination of features should not be construed as essential unless expressly stated as essential.

Figure 1:
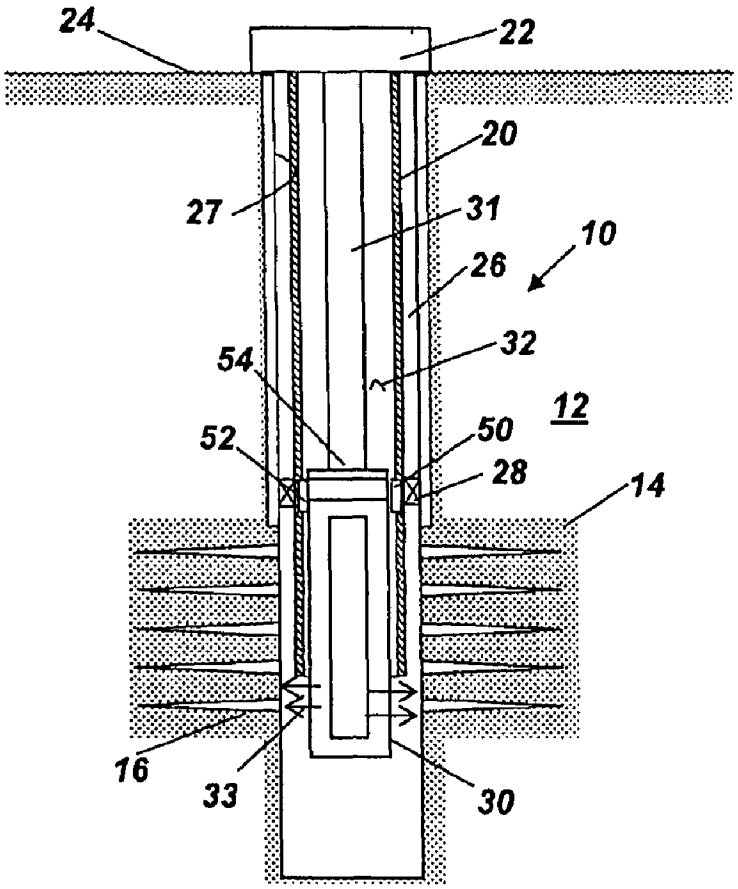
FIG. 1 is a schematic elevation view of a well having a downhole steam generator in accordance with one embodiment of the present disclosure that is injecting steam into a formation.

Referring initially to FIG. 1, there is shown an exemplary well 10 that has been drilled through the earth 12 and into a formation 14 from which it is desired to produce hydrocarbons. The formation 14 may have viscous oil having relatively low mobility. The well 10 is cased by metal casing 27, as is known in the art, and a number of perforations 16 penetrate and extend into the formation 14 so that production fluids may flow from the formation 14 into the wellbore 10. The wellbore 10 has a production tubing 20 that extends downwardly from a wellhead 22 at the surface 24 of the well 10. The production tubing string may be a single tubular or a string of jointed tubulars. A packer 28 may be used to isolate a selected region in the well 10. While the well 10 is shown as a cased well, it should be understood that the well may be partially cased. In addition, while the well 10 is shown as a land well, it should be understood that the teachings of the present disclosure may be equally applicable to offshore operations.

In embodiments of the present disclosure, hydrocarbons may be recovered from the formation 14 by utilizing thermal stimulation. The thermal stimulation may be provided by a steam generator 30 positioned in the well 10. The steam generator 30 may receive fuel and water via suitable conduits 31 that are supplied by sources (not shown) at the surface 24. In one arrangement, the steam generator 30 may be conveyed along with the production tubing string 20 for installation in the well 10. In another arrangement, the steam generator 30 is installed in the well 10 and thereafter the production tubing string 20 is installed into the well. In still another arrangement, the production tubing string 20 may be first installed into the well 10 and the steam generator 30 may be conveyed into the well via a bore 32 of the production tubing string 20.

During operation, the steam generator 30 generates and injects heated gas in the form of steam and combustion gases, collectively numeral 33, that pass into the oil-containing formation so that the reservoir oil is heated and reduced in viscosity. The duration of steam generator 30 operation can be varied as deemed appropriate. For example, the desired period of time may be, for example, from about one to about two months or until a desired volume of steam is injected.

In certain applications, after steam generation has been terminated, the well 10 may be shut-in to allow the formation 14 to undergo a soak period that enables the steam in the formation 14 to deliver heat to the in-place viscous oil prior to opening the well 10 to production. The soak period may continue until the viscous oil is sufficiently heated to flow more readily through the formation 14 into the well 10. In another aspect of the invention, the soak period may continue until no live steam is produced from the well after opening the well 10 to production.

Referring now to FIG. 2, the steam generator 30 may be extracted from the well 10 after steam generation has stopped. In one embodiment, the steam generator 30 may be extracted from the well 10 through the bore 32 of the production tubing string 20. For example, a non-rigid carrier 34, such as a wireline or a slickline, connected to the steam generator 30 may be tripped into the well 10 and connected to the steam generator 30. In other embodiments, a rigid carrier (not shown) such as coiled tubing or jointed tubulars may be used as a conveyance device. For example, in embodiments, the non-rigid carrier 34 may be provided with a connector element 36 that selectively connects and disconnects with the steam generator 30. The coupling element 36 may include a hydraulic, pneumatic, electrical, electromechanical or other suitable connection arrangement. After the coupling element 36 is connected to the steam generator 30, the non-rigid carrier 34 may be tripped out of the well 10 to extract the steam generator 30. In other embodiments, the non-rigid carrier 34 may remain attached to the steam generator 30 while the steam generator 30 is in the well 10.

Figure 4:
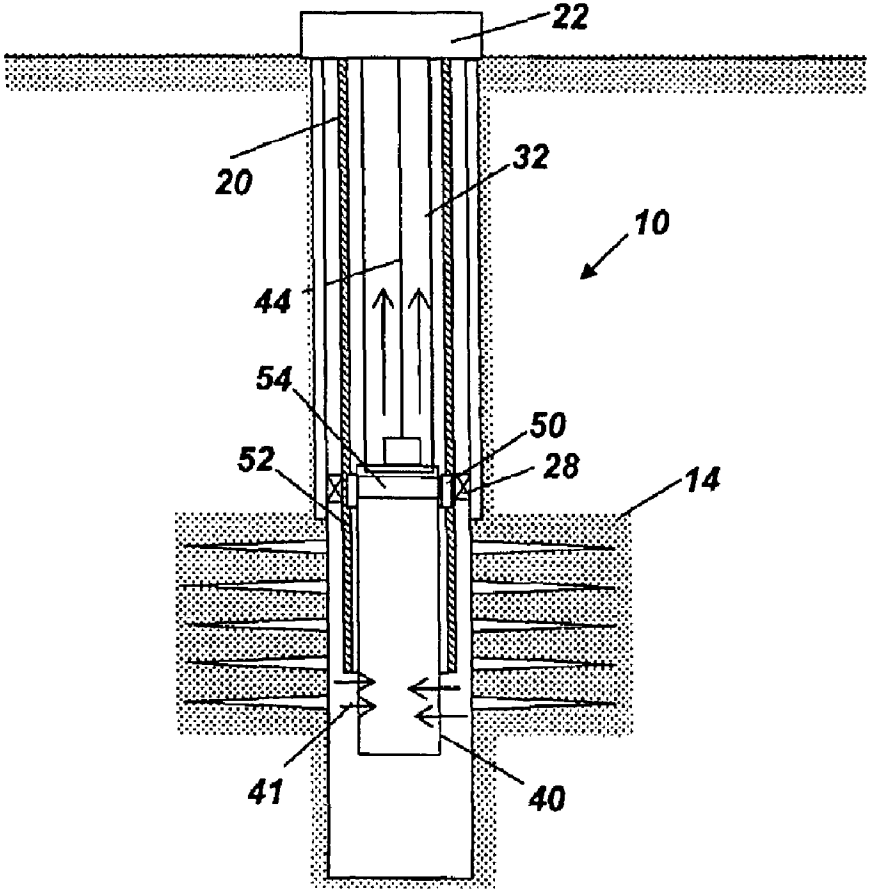
FIG. 4 is a schematic elevation view of a well wherein the submersible pump pumping formation fluids to the surface in accordance with one embodiment of the present disclosure.
Figure 3:
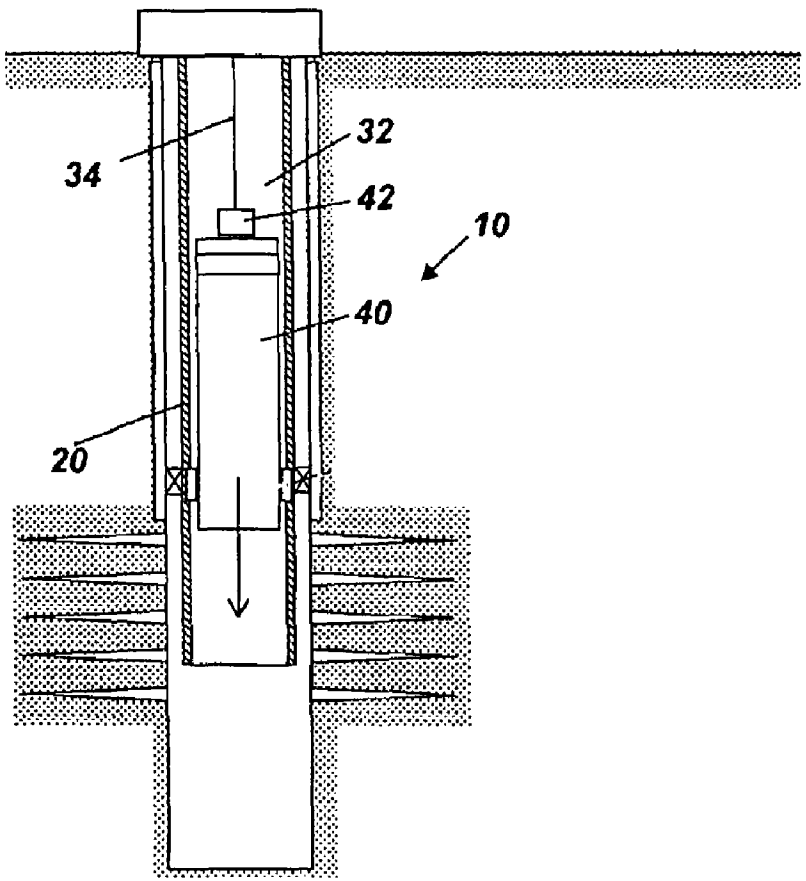
FIG. 3 is a schematic elevation view of a well wherein a submersible pump in accordance with one embodiment of the present disclosure is being conveyed into the well via the bore of the production tubing string.

Referring now to FIG. 3, after the steam generator 30 (FIG. 2) has been removed from the well 10, a pump 40 is coupled to the non-rigid carrier 34 and conveyed into the well 10. In embodiments, the non-rigid carrier 34 may be provided with a connector element 42 that selectively connects and disconnects with the pump 40. The connector element 42 may be configured the same as or differently from the connector element 36 (FIG. 2) for the steam generator 30 (FIG. 2). The pump 40 may be positioned at the same location as the steam generator 30 (FIG. 1) or at a different location. In arrangements, the pump 40 may be a downhole electric submersible pump (ESP), a downhole electrical progressive cavity pump, or some other type of downhole pump which is configured to convey formation fluids to the surface via the bore 32 of the production tubing string 20. In other embodiments, the pump 40 may utilize a different energy source, such as pressurized fluid. Referring now to FIG. 4, as discussed previously, in certain situations, the natural driving forces may be sufficient to enable hydrocarbons to flow into the well, but insufficient to enable the hydrocarbons to flow to the surface. Thus, the pump 40 may be operated to pump formation fluids 41 to the surface via the bore 32 of the production tubing string 20. If the pump 40 is electrically energized, then a conductor 44 may supply electrical power from a surface source (not shown) to the pump 40. In other embodiments, the pump 40 may be hydraulically actuated using pressurized fluid. In such embodiments, the conductor 44 may be replaced with hydraulic hose or tubing that conveys the pressurized fluid to the pump 40.

After some time, the formation fluids may return to a more viscous state due to the relatively low temperature of the formation 14. In order to re-stimulate the formation fluids with steam, the pump 40 may need to be extracted from the well 10. Referring generally to FIG. 3, in one mode of extraction, a conveyance device such as the non-rigid carrier 34 is conveyed into the well 10 and connected to the coupling device 42 at the pump 40. Once connected, the pump 40 may be extracted out of the well 10 via the bore 32 of the production tubing string 20. Referring now to FIG. 2, after extraction of the pump 40, the steam generator 30 may conveyed into the well 10 also via the bore 32 of the production tubing string 20 in much the same manner as when the steam generator 30 was pulled out of the well 10. The steam generator 30 may thereafter be positioned as needed in the well 10. The steam generator 30 may then be operated to stimulate the formation with thermal energy. The process may be repeated as desired.

It should be appreciated that the stream generator 30 and the pump 40 may be deployed into the well 10 and extracted out of the well 10 without having to remove the production tubing string 20.

In embodiments, the steam generator 30 and/or the pump 40 may be installed in the well 10 using a variety of arrangements. Exemplary arrangements may include attaching these devices to the production tubing string, suspending the devices from a power cable or tubing supplying an energy source (e.g., electrical power or hydraulic fluid), supporting the devices using a well packer or bridge plug device or anchoring these devices in a downhole landing nipple. In embodiments, the steam generator 30 and the pump 40 may utilize different attachment bases in the well 10. In other embodiments, the steam generator 30 and the pump 40 may utilize a common base 50. The base 50 may be positioned at a bottom end 52 of the production tubing string 20 or in the bore of the cased or partially cased well 10 itself; i.e., external to the production tubing string 20. The base 50 may be configured to connect with the steam generator 30 and the pump 40 through an electrical, mechanical, electromechanical, pneumatic or hydraulic connector. In certain embodiments, the steam generator 30 and the pump 40 may include a common connector 54 such that both devices can be interchangeably secured to the base 50. While the base 50 may be configured as a seat-like member on which the steam generator 30 or the pump 40 may be positioned, the base 50 may also be configured as device or member from which the steam generator 30 or the pump 40 may be hung or suspended.

Thus, it should be appreciated that in certain embodiments, the steam generator 30 and the pump 40 may be deployed in the well using the same equipment. That is, a common connector element 36 may be used to connect with the steam generator 30 and the pump 40 and the same base 50 may be used to receive and secure the steam generator 30 and the pump 40 in the well 10.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. A method of recovering heavy oil hydrocarbons to the surface of the earth from a subterranean formation, comprising:(a) positioning a steam generator in a wellbore intersecting the subterranean formation, wherein the steam generator is placed on a landing nipple;(b) installing a production tubing string in the wellbore;(c) conveying the steam generator to the surface via a bore of the production tubing string; and (d) conveying a pump into the wellbore via the bore of the production tubing string, wherein the pump is placed on the landing nipple; and wherein a packer is located between the wellbore and the production tubing adjacent to the landing nipple.

2. The method of claim 1 wherein said wellbore is at least partially cased.

3. The method of claim 1 further comprising: installing a base in the wellbore;

positioning the steam generator on the base; and positioning the pump on the base after the retrieving the steam generator.

4. The method of claim 1 further comprising conveying the pump to the surface via the bore of the production tubing string.

5. The method of claim 1 further comprising conveying the steam generator into the wellbore via the bore of the production tubing string.

6. The method of claim 1 further comprising using a non-rigid carrier to convey one of: (i) the steam generator, and (ii) the pump.

7. The method of claim 1 further comprising pumping a fluid to the surface via the production tubing string using the pump.

8. The method of claim 7 further comprising: conveying the pump to the surface via the bore of the production tubing string; conveying the steam generator into the wellbore via the bore of the production tubing string; injecting steam into the subterranean formation using the steam generator; conveying the steam generator to the surface via the bore of the production tubing string; conveying the pump into the wellbore via the bore of the production tubing string; and pumping a fluid to the surface via the production tubing string using the pump.

9. A method of recovering heavy oil hydrocarbons to the surface of the earth from a subterranean formation, comprising: (a) positioning a steam generator in a wellbore intersecting the subterranean formation, wherein the steam generator is placed on a landing nipple;(b) installing a production tubing string in the wellbore; (c) conveying the steam generator to the surface via a bore of the production tubing string; and (d) conveying a pump into the wellbore via the bore of the production tubing string, wherein the pump is placed on the landing nipple; wherein stream from the steam generator is injected into the subterranean formation and soaked for at least one month followed by a soak period, and wherein a packer is located between the wellbore and the production tubing adjacent to the landing nipple.

10. A method of recovering heavy oil hydrocarbons to the surface of the earth from a subterranean formation, comprising: (a) positioning a steam generator in a wellbore intersecting the subterranean formation, wherein the steam generator is placed on a landing nipple;(b) installing a production tubing string in the wellbore; (c) conveying the steam generator to the surface via a bore of the production tubing string; and (d) conveying a pump into the wellbore via the bore of the production tubing string, wherein the pump is placed on the landing nipple; wherein steam and exhaust gases from the steam generator are injected into the subterranean formation; wherein the stream from the steam generator is injected into the subterranean formation for at least one month followed by a soak period, and wherein a packer is located between the wellbore and the production tubing adjacent to the landing nipple.

* * * * *